US010052251B1

(12) United States Patent
Lu

(10) Patent No.: US 10,052,251 B1
(45) Date of Patent: Aug. 21, 2018

(54) STRUCTURE FOR CREMAINS CONTAINER

(71) Applicant: Tsung-Hua Lu, Kaohsiung (TW)

(72) Inventor: Tsung-Hua Lu, Kaohsiung (TW)

( * ) Notice: Subject to any disclaimer, the term of this patent is extended or adjusted under 35 U.S.C. 154(b) by 0 days.

(21) Appl. No.: 15/678,211

(22) Filed: Aug. 16, 2017

(51) Int. Cl.
*A61G 17/08* (2006.01)

(52) U.S. Cl.
CPC ..... *A61G 17/08* (2013.01)

(58) Field of Classification Search
CPC ..... A63H 3/52; A63H 33/044; A61G 17/08; E04H 13/008
USPC ..... 27/1; 446/478, 110, 131, 120; 211/85.27; D21/507, 511
See application file for complete search history.

(56) References Cited

U.S. PATENT DOCUMENTS

D44,041 S * 5/1913 Thayer et al. ..... 446/478
1,333,181 A * 3/1920 Mathews ..... A63H 33/42 446/478
2,600,900 A * 6/1952 McNeill ..... A63H 33/044 446/110
2,771,110 A * 11/1956 Tuck ..... A01K 31/14 144/379
2,841,919 A * 7/1958 McNeill ..... A63H 33/044 446/115
D268,201 S * 3/1983 McElhaney ..... D21/507
4,508,519 A * 4/1985 Becker ..... A63H 33/00 446/478
D282,674 S * 2/1986 Marschak ..... D21/511
4,883,443 A * 11/1989 Chase ..... A63H 3/52 446/478
4,978,301 A * 12/1990 Dodge ..... A63H 33/042 434/96
5,890,338 A * 4/1999 Rodriguez-Ferre .. A63H 33/008 256/26
6,065,253 A * 5/2000 Ojeda ..... A63H 3/52 446/131
6,073,404 A * 6/2000 Norfleet ..... A63H 33/044 446/109
7,980,918 B1 * 7/2011 Prilutsky ..... A63H 33/062 446/120
D677,342 S * 3/2013 Hall ..... D21/511
2002/0193046 A1 * 12/2002 Zebersky ..... A63H 3/52 446/476
2012/0225603 A1 * 9/2012 Trinch ..... A63H 3/52 446/92

* cited by examiner

*Primary Examiner* — William L Miller
(74) *Attorney, Agent, or Firm* — Alan D. Kamrath; Kamrath IP Lawfirm, P.A.

(57) ABSTRACT

An ornamental structure for a cremains container includes a modeling unit (10) and at least one landscaping unit (20) connected with the modeling unit. The modeling unit includes a front plate (11), two side plates (12) and a top cap (13). The modeling unit has an interior defining a receiving space (14) to receive a cremains container (30). The at least one landscaping unit includes a main body (21) and a plurality of decorative members (22) mounted on the main body. Thus, the ornamental structure partially covers and decorates the cremains container.

11 Claims, 5 Drawing Sheets

STRUCTURE FOR CREMAINS CONTAINER

BACKGROUND OF THE INVENTION

1. Field of the Invention

The present invention relates to a cremains container and, more particularly, to an ornamental structure for a cremains container.

2. Description of the Related Art

In the modern times, the dead body was usually incinerated in a cremation process, and the cremains of the dead body after cremation was stored in a cremains container. However, a conventional cremains container is only used to store the cremains of the dead body after cremation and cannot provide a decorative effect, thereby limiting the aesthetic quality of the cremains container, and thereby easily providing an awful sensation to the watcher.

BRIEF SUMMARY OF THE INVENTION

The primary objective of the present invention is to provide an ornamental structure for beautifying the storage space of a cremains container, so as to change the monotonous arrangement of the cremains container, and to provide stabilized vision and psychological sensation to the user.

In accordance with the present invention, there is provided an ornamental structure for a cremains container, comprising a modeling unit and at least one landscaping unit connected with the modeling unit. The modeling unit includes a front plate, two side plates and a top cap. The modeling unit has an interior defining a receiving space to receive a cremains container. The at least one landscaping unit includes a main body and a plurality of decorative members mounted on the main body.

Preferably, the modeling unit is provided with a plurality of positioning holes, and the at least one landscaping unit is provided with a plurality of positioning bosses positioned in the positioning holes of the modeling unit.

Preferably, the modeling unit is provided with a first connecting portion, and the at least one landscaping unit is provided with a second connecting portion connected with the first connecting portion of the modeling unit. The first connecting portion of the modeling unit and the second connecting portion of the at least one landscaping unit include permanent magnets, locking fasteners or latches.

Preferably, the modeling unit further includes a rear plate located between the two side plates.

Preferably, the front plate is located between and removably connected with the two side plates.

According to the primary advantage of the present invention, the modeling unit efficiently covers the cremains container to reduce the serious atmosphere of the cremains container, thereby building a beautiful and fresh viewing sensation to the spectator.

According to another advantage of the present invention, the at least one landscaping unit provide a decorative effect to the cremains container to enhance the aesthetic quality of the cremains container.

According to a further advantage of the present invention, the modeling unit and the at least one landscaping unit have diverse types and designs to satisfy various requirements of different consumers.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
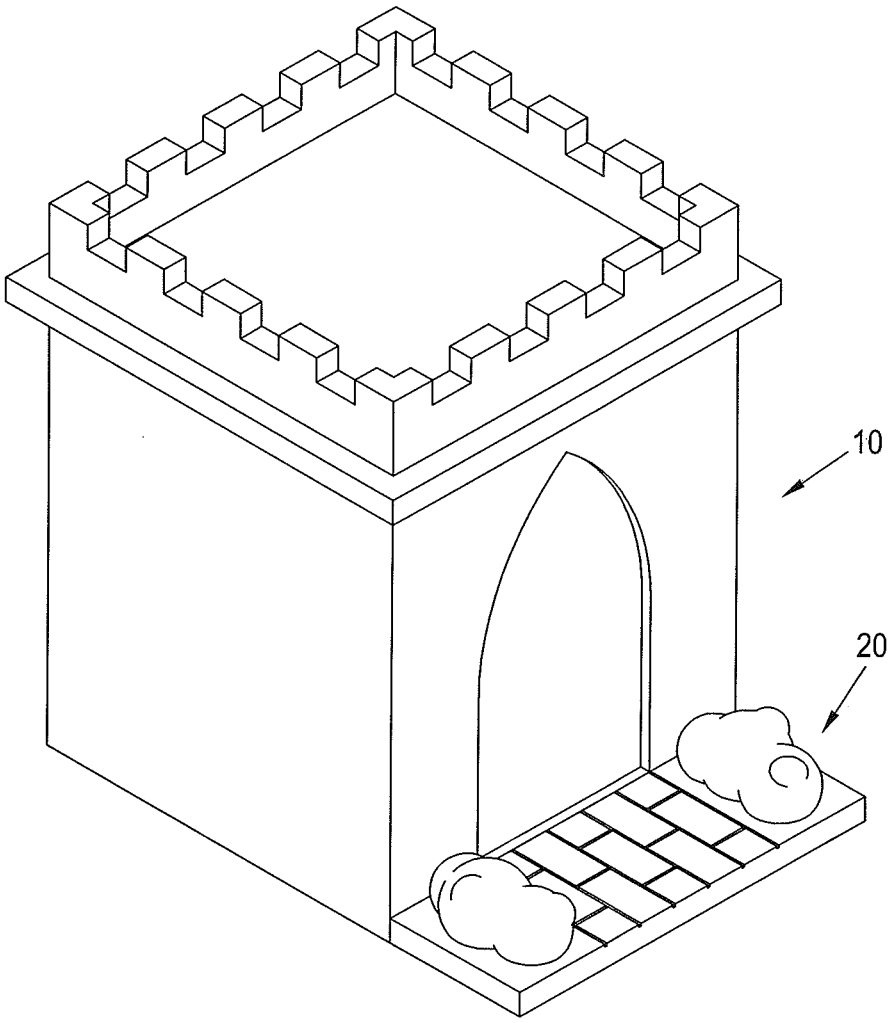
FIG. 1 is a perspective view of an ornamental structure for a cremains container in accordance with the preferred embodiment of the present invention.
Figure 2:
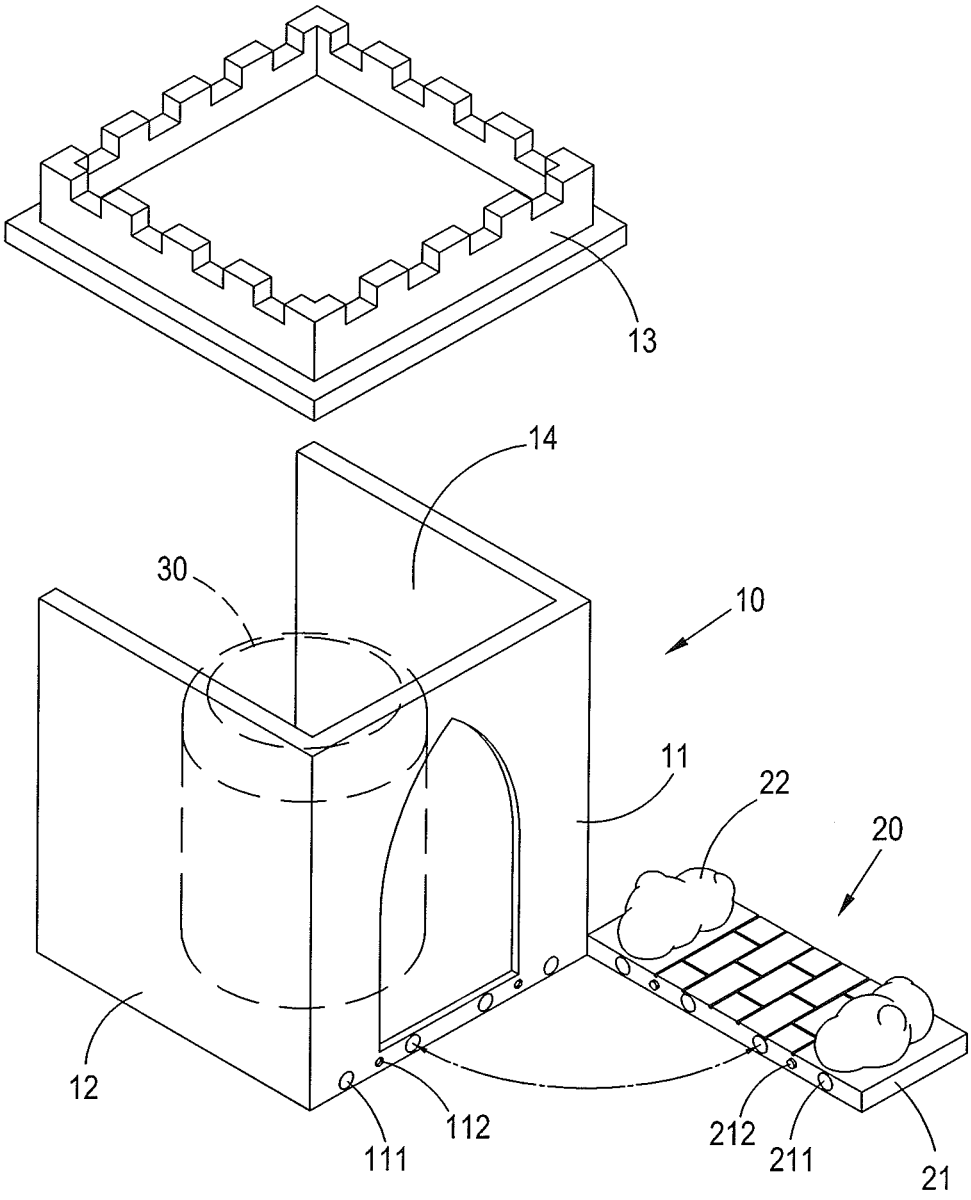
FIG. 2 is an exploded perspective view of the ornamental structure for a cremains container in accordance with the preferred embodiment of the present invention.
Figure 3:
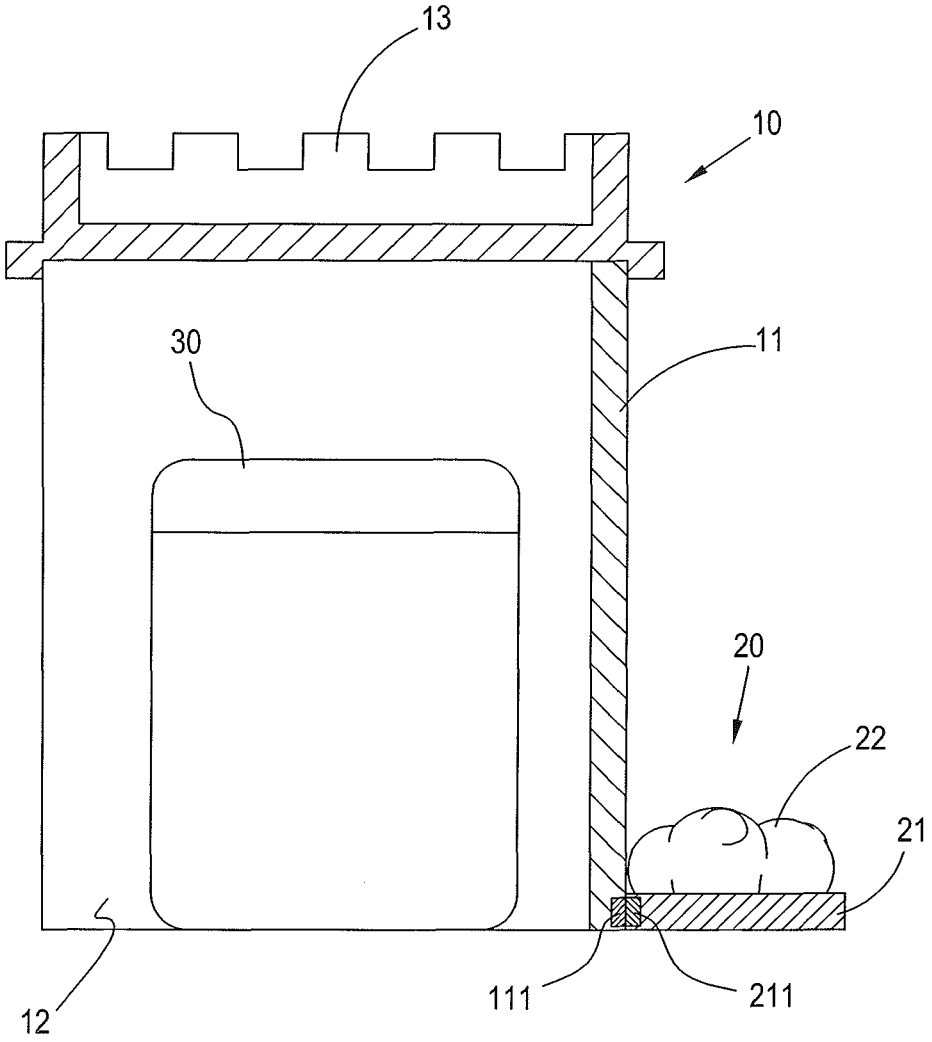
FIG. 3 is a side cross-sectional view of the ornamental structure for a cremains container in accordance with the preferred embodiment of the present invention.

Referring to the drawings and initially to FIGS. 1-3, an ornamental structure for a cremains container in accordance with the preferred embodiment of the present invention comprises a modeling unit 10 and at least one landscaping unit 20 connected with the modeling unit 10.

The modeling unit 10 includes a front plate 11, two side plates 12 and a top cap 13. The modeling unit 10 has an interior defining a receiving space 14 to receive a cremains container 30. The receiving space 14 of the modeling unit 10 is defined between the front plate 11, the two side plates 12 and the top cap 13. The modeling unit 10 is a housing having a determined shape to cover the cremains container 30.

The at least one landscaping unit 20 has a configuration matching that of the modeling unit 10. The at least one landscaping unit 20 includes a main body 21 and a plurality of decorative members 22 mounted on the main body 21. The at least one landscaping unit 20 is designed to have an artificial landscape to enhance the aesthetic quality of the cremains container 30.

In the preferred embodiment of the present invention, the modeling unit 10 is provided with a plurality of positioning holes 112, and the at least one landscaping unit 20 is provided with a plurality of positioning bosses 212 positioned in the positioning holes 112 of the modeling unit 10.

In the preferred embodiment of the present invention, the modeling unit 10 is provided with a first connecting portion, and the at least one landscaping unit 20 is provided with a second connecting portion connected with the first connecting portion of the modeling unit 10.

In the preferred embodiment of the present invention, the first connecting portion of the modeling unit 10 and the second connecting portion of the at least one landscaping unit 20 include permanent magnets, locking fasteners or latches.

In the preferred embodiment of the present invention, the modeling unit 10 is provided with a plurality of first permanent magnets 111, and the at least one landscaping unit 20 is provided with a plurality of second permanent magnets 211 magnetically attracted by the first permanent magnets 111 of the modeling unit 10 to connect the modeling unit 10 with the at least one landscaping unit 20.

As shown in FIG. 3, the modeling unit 10 covers the cremains container 30 to prevent the cremains container 30 from being directly exposed to the ambient environment.

Accordingly, the modeling unit 10 efficiently covers the cremains container 30 to reduce the serious atmosphere of the cremains container 30, thereby building a beautiful and fresh viewing sensation to the spectator. In addition, the at least one landscaping unit 20 provide a decorative effect to the cremains container 30 to enhance the aesthetic quality of the cremains container 30. Further, the modeling unit 10 and the at least one landscaping unit 20 have diverse types and designs to satisfy various requirements of different consumers.

Figure 4:
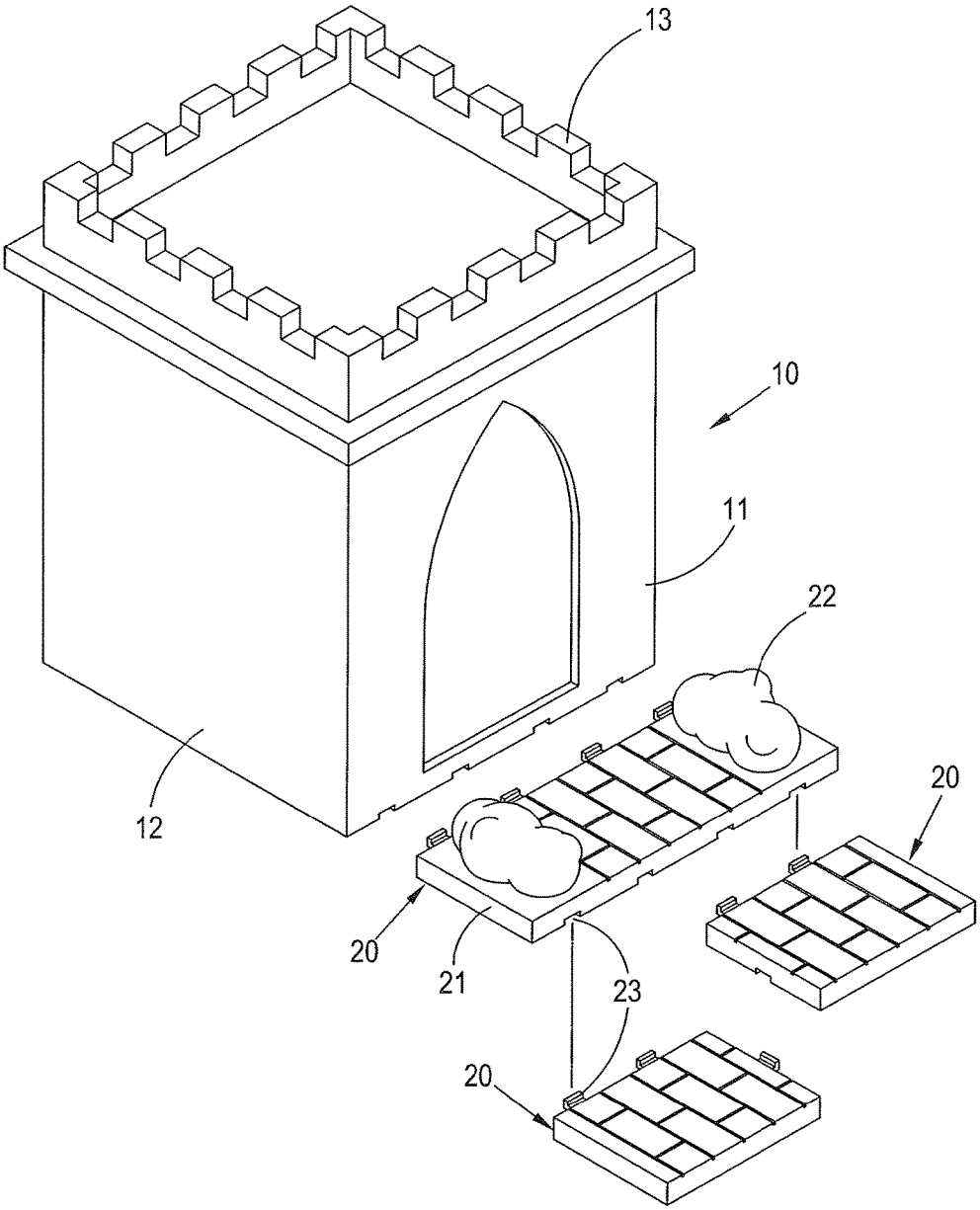
FIG. 4 is an exploded perspective view of an ornamental structure for a cremains container in accordance with another preferred embodiment of the present invention.

Referring to FIG. 4, the ornamental structure comprises a plurality of landscaping units 20 connected with the modeling unit 10. Preferably, the landscaping units 20 are connected with each other by a plurality of locking mechanisms 23. Thus, the landscaping units 20 are assembled and expanded to form a landscape having a larger area.

Figure 5:
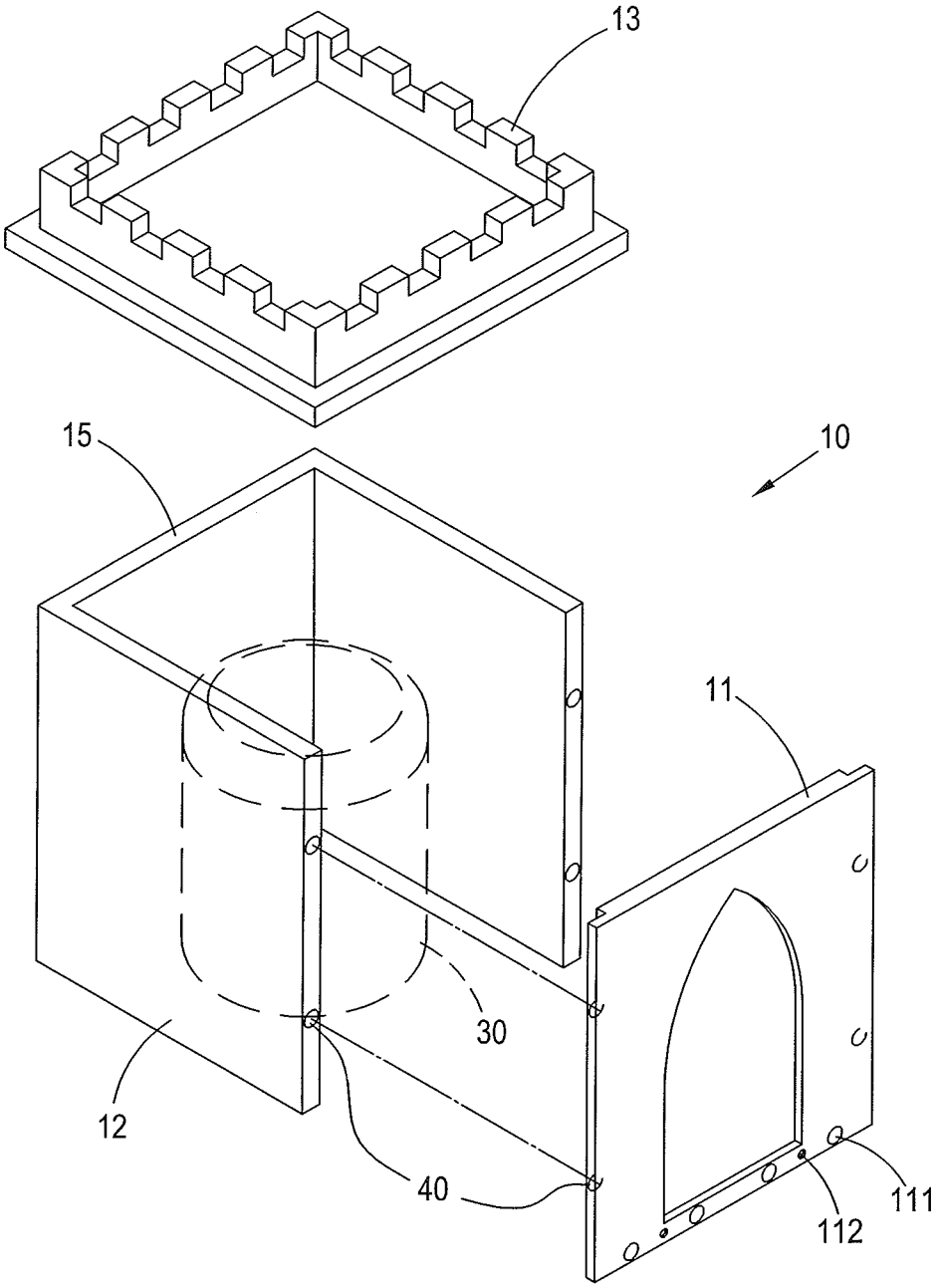
FIG. 5 is an exploded perspective view of an ornamental structure for a cremains container in accordance with a further preferred embodiment of the present invention.

Referring to FIG. 5, the modeling unit 10 further includes a rear plate 15 located between the two side plates 12, and the front plate 11 is located between and removably connected with the two side plates 12. Preferably, the front plate 11 is connected with the two side plates 12 by permanent magnet units 40.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. In combination, a cremains container for storing cremated remains of a deceased and an ornamental structure, comprising:

the ornamental structure including:

a modeling unit;

at least one landscaping unit connected with the modeling unit;

the modeling unit includes a front plate, two side plates and a top cap;

the modeling unit has an interior defining a receiving space;

the at least one landscaping unit includes a main body and a plurality of decorative members mounted on the main body; and wherein the cremains container is received in the receiving space of the modeling unit.

2. The combination of claim 1, wherein the modeling unit is provided with a plurality of positioning holes, and the at least one landscaping unit is provided with a plurality of positioning bosses positioned in the positioning holes of the modeling unit.

3. The combination of claim 1, wherein:

the modeling unit is provided with a first connecting portion;

the at least one landscaping unit is provided with a second connecting portion connected with the first connecting portion of the modeling unit; and the first connecting portion of the modeling unit and the second connecting portion of the at least one landscaping unit include permanent magnets, locking fasteners or latches.

4. The combination of claim 1, wherein the modeling unit further includes a rear plate located between the two side plates.

5. The combination of claim 4, wherein the rear plate and the two side plates of the modeling unit are formed integrally.

6. The combination of claim 1, wherein the front plate is located between and removably connected with the two side plates.

7. The combination of claim 1, wherein the main body of the at least one landscaping unit is juxtaposed to a bottom of the front plate of the modeling unit.

8. The combination of claim 1, wherein the main body of the at least one landscaping unit is located in front of the front plate of the modeling unit.

9. The combination of claim 1, wherein the main body of the at least one landscaping unit is perpendicular to the front plate of the modeling unit.

10. The combination of claim 1, wherein the front plate of the modeling unit and the main body of the at least one landscaping unit construct a substantially L-shaped construction.

11. The combination of claim 1, wherein the front plate and the two side plates of the modeling unit are formed integrally.

* * * * *